US009186900B2

(12) United States Patent
Ishida et al.

(10) Patent No.: US 9,186,900 B2
(45) Date of Patent: Nov. 17, 2015

(54) PRINTER AND PRINTING HEAD MOVING MECHANISM

(71) Applicant: Seiko Epson Corporation, Tokyo (JP)

(72) Inventors: Tetsugo Ishida, Shiojiri (JP); Ken Inoue, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

(21) Appl. No.: 13/625,337

(22) Filed: Sep. 24, 2012

(65) Prior Publication Data

US 2013/0076831 A1 Mar. 28, 2013

(30) Foreign Application Priority Data

Sep. 22, 2011 (JP) ..... 2011-207189

(51) Int. Cl.
*B41J 2/165* (2006.01)

(52) U.S. Cl.
CPC ..... *B41J 2/16588* (2013.01)

(58) Field of Classification Search
None
See application file for complete search history.

(56) References Cited

U.S. PATENT DOCUMENTS

| | | | | |
|---|---|---|---|---|
| 5,534,897 | A | 7/1996 | Anderson et al. | |
| 7,841,691 | B2 | 11/2010 | Yamada | |
| 2007/0291077 | A1* | 12/2007 | Seki et al. | 347/37 |
| 2008/0231653 | A1* | 9/2008 | Kawashima et al. | 347/29 |
| 2009/0026803 | A1* | 1/2009 | Yano et al. | 296/190.1 |
| 2009/0073213 | A1 | 3/2009 | Iwata | |
| 2012/0013660 | A1* | 1/2012 | Mano | 347/9 |

FOREIGN PATENT DOCUMENTS

| | | | |
|---|---|---|---|
| EP | 0 469 619 | A1 | 2/1992 |
| JP | 07-032602 | A | 2/1995 |
| JP | 2000-301710 | A | 10/2000 |
| JP | 2002-103638 | A | 4/2002 |
| JP | 2003-011377 | A | 1/2003 |
| JP | 2004-268511 | A | 9/2004 |
| JP | 2008-221623 | A | 9/2008 |
| JP | 2008-229982 | A | 10/2008 |
| JP | 2009-066870 | A | 4/2009 |

* cited by examiner

*Primary Examiner* — Alejandro Valencia
(74) *Attorney, Agent, or Firm* — Nutter McClennen & Fish LLP; John J. Penny, Jr.; Michael P. Visconti, III

(57) ABSTRACT

A printing head moving mechanism is configured to reciprocate a carriage equipped with a printing head between a printing position facing a recording medium and a retracted position retracted outside a printing region of the recording medium. In the printing position, the carriage is disposed at a downstream side of a transporting roller which is configured to transport the recording medium in a transporting direction of the recording medium. In the retracted position, at least a portion of the carriage is disposed at an upstream side of the transporting roller in the transporting direction of the recording medium. The carriage is configured to move between the printing position and the retracted position without interfering with the transporting roller.

1 Claim, 8 Drawing Sheets

PRINTER AND PRINTING HEAD MOVING MECHANISM

The disclosure of Japanese Patent Application No. 2011-207189 filed on Sep. 22, 2011, including specification, drawings and claims is incorporated herein by reference in its entirety.

TECHNICAL FIELD

The invention relates to a printer and a printing head moving mechanism capable of retracting a printing head from a top of a recording medium, moving the printing head to a position deviated from the recording medium, and standing by the printing head.

BACKGROUND

An inkjet printer which discharges ink on a recording medium from an ink nozzle to print the recording medium, for example, if the ink nozzle is clogged, a printing quality if deteriorated. Therefore, while a printing head is standing by, the printing head moves to a position (retraction position) deviated from a top of a platen to face a maintenance mechanism. Also, an ink nozzle surface is covered by a head cap to suppress evaporation of the ink, or the ink is forcibly discharged into the head cap to solve the clogging.

There is an inkjet printer employing a serial type printing head, in which a printing head is adapted to move in a direction perpendicular to a transporting direction of a recording medium, the recording head performs a printing while carrying out scanning in a width direction of the recording medium, and after the printing is completed, the printing head moves to a retraction position which is set beside a platen, and then is stood by. In such a kind of printer, as the maintenance unit is displaced under the retraction position, the maintenance unit is faced the ink nozzle surface of the printing head standing by, and the ink nozzle surface is capped to perform the maintenance.

In addition to this, there is another inkjet printer employing a line type printing head, in which ink nozzles are arranged in a width to cover the whole printing region of the recording medium, a printing head performs printing without moving in a width direction of a recording medium. In the inkjet printer employing the line type printing head, since a width dimension of the printing head itself is large, so ad to move the printing head in the width direction of the recording medium and retract it from a top of a platen, a space having the same width as the printing head of a wide width is necessary to empty. Accordingly, there is a problem in that a device width of the printer is increased.

Patent Document 1 discloses a printer (inkjet printing apparatus) including a line type printing head. In the printer disclosed in Patent Document 1, a rotational shaft is installed at a position deviated from a transport region of the recording medium in a width direction, and one end of the printing head is rotatably supported by the rotational shaft. When the maintenance of the printing head is carried out, the printing head is rotated around the rotational shaft, and the printing head is retracted from the top of the recording medium in a 90 degree-rotated posture. In the line type printing head, since the dimension of the recording medium in the transporting direction is smaller than the width dimension, the method of retracting the printing head can narrow the width of the retracting space of the printing head. Accordingly, the device width of the printer can be narrowed by using the method of moving the printing head.

Patent Document 1: Japanese Patent Application Publication No. 2000-301710A

Like Patent Document 1, in the configuration in which the printing head is rotated around a support shaft which is installed at one end thereof, the width of the space occupied by the printing head retracted from the top of the platen is narrowed, but the printing head passes a sector-shaped moving region, in which the support shaft serves as a center of the sector. So as to prevent interference of the printing head, other component should be provided to avoid the sector-shaped moving region. For example, in the configuration in which the printing head moves in the width direction only, like the related art, when components, such as a transporting roller, can come close to an upstream side of the printing head which is positioned at a position (printing position) facing the recording medium, when seen from the transporting direction of the recording medium, and then dispose at the position. However, in the case where the printing head is rotated to move, like Patent Document 1, a component, such as a transporting roller, should be disposed so as not to overlap with the sector-shaped moving region. For this reason, the installing size of the whole transporting mechanism becomes large. In order to avoid the interference of the transporting roller at the upstream side, a sector-shaped moving region may be set at a downstream side, while the rotation direction of the printing head is reversed. Since a component, such as a cutter, is disposed at the downstream side, however, there is a problem in that the installing location of the cutter should be changed.

In this way, if the printing head is rotated around the support shaft, like Patent Document 1, the components which can be disposed near the printing head should be disposed away from the printing away. Accordingly, since a space for installing a component retracting the printing head from the moving region is separately required, there is a problem in that the apparatus is increased in size.

SUMMARY

It is therefore an object of at least one embodiment of the present invention to provide a printing head moving mechanism which can narrow a width of a retracting space when retracting a printing head to a position (retracting position) deviating from a top of a recording medium, and make a moving region of the printing head small when moving between a printing position and the retracting position, relative to a related art, and a printer including the same.

According to an aspect of the embodiments of the present invention, there is provided a printing head moving mechanism configured to reciprocate a carriage equipped with a printing head between a printing position facing a recording medium and a retracted position retracted outside a printing region of the recording medium, wherein in the printing position, the carriage is disposed at a downstream side of a transporting roller which is configured to transport the recording medium in a transporting direction of the recording medium, wherein in the retracted position, at least a portion of the carriage is disposed at an upstream side of the transporting roller in the transporting direction of the recording medium, and wherein the carriage is configured to move between the printing position and the retracted position without interfering with the transporting roller.

The present invention can move the carriage between the printing position and the retracted position, without interfering with the transporting rollers, even in a case where at least a portion of the retracted position of the carriage is set to emerge to an upstream side of the transporting roller. Accordingly, in the case where the retracted position is set (e.g., in a case where a wide carriage rotates and then takes a vertically long posture), it is not necessary to retract the transporting roller to the upstream side. As a result, a printing mechanism and a transporting mechanism can be intensively disposed in a narrow space, so that it is advantageous to downsizing of an apparatus.

The printing head moving mechanism may comprise a rotating shaft configured to rotatably support the carriage about a rotating axis perpendicular to an ink nozzle surface of the printing head, and when the carriage moves between the printing position and the retracted position, a posture of the carriage may be changed as the rotating shaft moves. In this way, even though the configuration is simple, it is possible to change the posture of the carriage while it moves between the printing position and the retracted position.

In at least a portion of a moving region between the printing position and the retracted position, when the carriage moves toward the retracted position, a posture of the carriage may be changed such that a trailing end portion of the carriage in a moving direction thereof moves along a straight moving path while a leading end portion of the carriage in the moving direction thereof moves away from the straight moving path, and when the carriage moves toward the printing position, a posture of the carriage may be changed such that a leading end portion of the carriage in a moving direction thereof moves along the straight moving path while a trailing end portion of the carriage in the moving direction thereof comes close to the straight moving path.

In this way, it is possible to change the posture of the carriage while it moves from the printing position to the retracted position. Also, it is possible to rotate the carriage, which is disposed long in a horizontal direction to cover the recording medium in the width direction at the printing position, toward the retracted position, and the carriage can take the vertically long posture. In addition, when returning to the printing position, the carriage can move in a reverse process. Accordingly, the width of the retracted space of the carriage can be narrowed. Also, since the posture of the carriage can be changed to rotate around the rear end portion, the moving region of the carriage can be narrowed as compared to the case where the carriage rotates in the shape of sector. As a result, a printing mechanism and a transporting mechanism can be intensively disposed in a narrow space, so that it is advantageous to downsizing of an apparatus.

The printing head moving mechanism may comprise: a first guide section configured to guide one end of the carriage in a width direction thereof along the straight moving path; and a second guide section configured to guide a guided portion which is provided in a portion of the carriage, positioned at a front side of the one end of the carriage in a moving direction when the carriage moves from the printing position toward the retracted position, along a moving path including a path portion which is away from the straight moving path as the path portion proceeds toward the retracted position. In this way, the posture can be changed in which the one end of the carriage is guided in a straight toward the retracted position by the first guide section, so that while the carriage wholly moves to the retracted position, the guided portion serving as the leading end is moved in a direction away from the straight moving direction; as the carriage moves to the retracted position, the carriage rotates to increase a slope of the carriage. Accordingly, the carriage takes the vertically long posture at the retracted position, thereby narrowing the width of the retracted space. Also, the moving region of the carriage toward the retracted position can be narrowed as compared to the case where the carriage rotates in the shape of sector.

The printing head moving mechanism may further comprise a driving unit configured to reciprocates the one end of the carriage in the width direction thereof along the straight moving path. In this way, the driving direction by the driving unit is only the reciprocating movement of a straight direction, and a driving unit for moving the carriage along a complicated path is not required. Accordingly, it is possible to simplify the configuration of the driving unit.

The path portion in the moving path by the second guide section, which extends in a direction away from the straight moving path may be an arc-shaped moving path. In this way, it is possible to smoothly rotate and move the carriage.

The second guide section may include: a first straight guide portion provided at an end portion of the moving path of the guided portion at a side of the printing position and configured to guide the guided portion along a first straight path parallel to the straight moving path; and an arc-shaped guide portion connected to an end portion of the first straight guide portion at a side of the retracted position and configured to guide the guided portion along the arc-shaped moving path. In this way, while the guided portion is guided by the first straight guide portion, the carriage can move in the width direction with the posture at the printing position. Accordingly, it is possible to finely adjust the position of the carriage within the range of the first straight guide portion, and it is possible to align the position of the printing head in the width direction with respect to the recording medium.

The printing head moving mechanism may further comprise a rotating shaft configured to rotatably support the one end of the carriage in the width direction thereof, which is guided by the first guide section about a rotating axis perpendicular to an ink nozzle surface of the printing head, and the first guide section may include: a slider supporting the rotating shaft; and a guide member configured to guide the slider in a direction parallel to the straight moving path. In this way, the configuration is simple, and it is possible to reciprocate the carriage in the straight in the rotatable state.

The rotating shaft may extend in a vertical direction, and the first guide section may further include: an upper guide roller provided at an upper end portion of the rotating shaft; a lower guide roller provided at a lower end portion of the rotating shaft; an upper guide disposed above the guide member and configured to guide the upper guide roller in a direction along the straight moving path; and a lower guide disposed below the guide member and configured to guide the lower guide roller in the direction along the straight moving path. In this way, since the upper and lower ends of the rotating shaft are guided, the tilting of the rotating shaft can be prevented. Accordingly, it is possible to prevent the tilting of the carriage and improve the printing precision by suppressing the tilting of the ink nozzle surface of the printing head and variation in gap of the platen.

The upper guide may be disposed at a side of a center of gravity of the carriage relative to the upper guide roller, and the lower guide may be disposed at a side opposite to the center of gravity of the carriage relative to the lower guide roller. In this way, the rotating shaft is prevented from tilting toward the center of gravity of the carriage, it is possible to effectively prevent the tilting of the carriage in the case where the carriage is supported in the cantilever state by the rotating state.

The second guide section may includes: a guide rail disposed above the carriage; and a suspending portion configured to travel along the guide rail in a state where the guided portion is suspended from the guide rail. In this way, since the second guide section is configured to save the space by the monorail structure for suspending and guiding the carriage from the guide rail which is disposed at the upper portion, it is possible to suppress the increase in device width.

According to an aspect of the embodiments of the present invention, there is provided a printer comprising: the printing head moving mechanism described above, a printing head configured to eject ink within a range from one end to the other end of a printing region on the recording medium in a width direction thereof when the printing head is disposed in the printing position and configured to be moved by the printing head moving mechanism between the printing position and the retracted position; a transporting unit configured to transport the recording medium along a transport path by way of the printing position; and a maintenance unit configured to perform maintenance of the printing head moved to the retracted position.

According to the present invention, even in the case where at least a portion of the retracted position of the carriage is set to emerge to the upstream side of the transporting roller, the carriage can move between the printing position and the retracted position, without interfering with the transporting rollers. Accordingly, in the case where the retracted position is set, it is not necessary to retract the transporting roller to the upstream side. As a result, a printing mechanism and a transporting mechanism can be intensively disposed in a narrow space, so that it is advantageous to downsizing of an apparatus.

DETAILED DESCRIPTION OF THE EMBODIMENTS

A printer according to the present invention and a printing head moving mechanism thereof will now be described with reference to the accompanying drawings.

(Whole Configuration)

Figure 1:
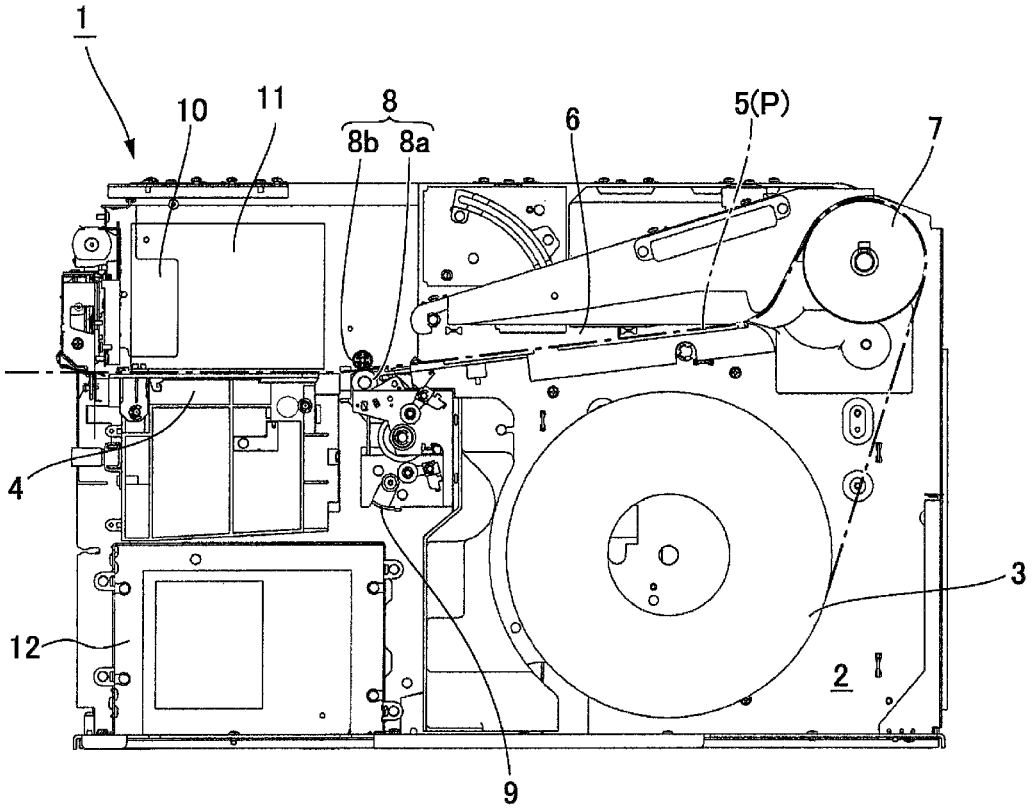
FIG. 1 is a cross-sectional view illustrating the whole configuration of a printer according to an embodiment.

FIG. 1 is a cross-sectional view illustrating the whole configuration of a printer according to the embodiment. The inkjet printer 1 (hereinafter, referred to as a printer 1) performs a printing of an elongated recording paper P (recording medium) using several kinds of color ink. The printer 1 is provided at its rear portion with a rolled-sheet loading section 2, and the recording paper P drawn from the loaded roll sheet 3 is conveyed to a front of the printer along a recording paper transport path 5 by way of a surface of a platen 4 which is disposed at the front of the rolled-sheet loading section 2.

A paper guide 6 for preventing skew of the recording paper P is disposed over the rolled-sheet loading section 2, and a delivery roller 7 for drawing the recording paper P from the rolled sheet 3 is disposed behind the paper guide 6. The recording paper P is obliquely drawn rearward from the rolled sheet 3 to the delivery roller 7, and then is wound around the delivery roller 7. The recording paper P drawn forward from the delivery roller 7 is adapted to pass the surface of the platen by way of a load roller (not illustrated) disposed at the rear of the paper guide 6, and the paper guide 6 and a pair of transporting rollers disposed in the front of the paper guide 6. The pair of transporting rollers 8 includes a driving roller 8*a* abutting against the recording paper from a lower side, and a driven roller 8*b* (transporting roller) resiliently biased from the upper portion of the driving roller 8*a*. Also, the driving roller 8*a* and the driven roller 8*b* can be upside down. Below the pair of transporting rollers 8, a paper transporting motor 9 for rotating the driving roller 8*a* forward and backward is disposed. The delivery roller 7 includes a transporting unit for transporting the recording paper P forward and backward along the recording paper transport path 5 using the pair of transporting rollers 8, the paper transporting motor 9, or the like.

Over the platen 4, an inkjet head 11 (printing head) equipped with a carriage 10 is disposed. Below the platen 4, an ink cartridge mounting section 12 is provided. The ink cartridge mounting section 12 is mounted with an ink cartridge for respectively storing four colors of ink, such as cyan, magenta, yellow and black. If the ink cartridge is mounted on the ink cartridge mounting section 12, an ink tank in the ink cartridge is connected to a pump mechanism (not illustrated) for supplying the ink via an ink supply pipe (not illustrated), so that the ink can be supplied to the inkjet head 11.

Figure 2A:
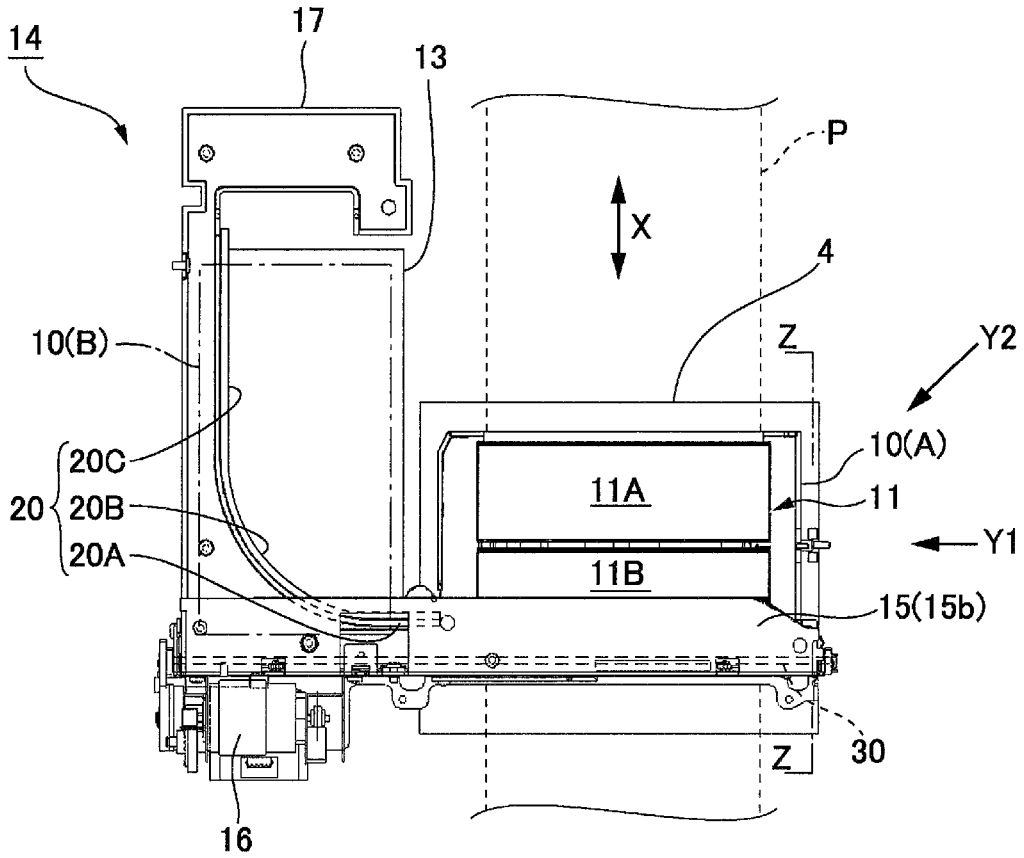
FIGS. 2A and 2B are diagrams of an inkjet head and a head moving mechanism.
Figure 2B:
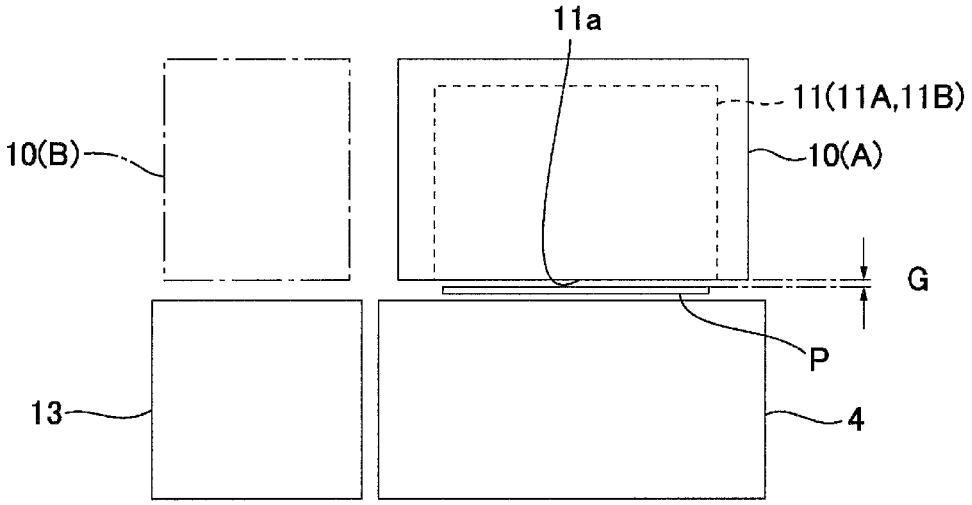

FIGS. 2A and 2B are diagrams of the inkjet head and the head moving mechanism. FIG. 2A is a diagram illustrating a plan configuration, and FIG. 2B is a diagram illustrating a schematic cross-sectional configuration when seen from the front side of the printer. As illustrated in FIG. 2A, the inkjet head 11 is a combined head having a first head 11A and a second head 11B. The first head 11A is provided with an ink nozzle row for discharging black ink and cyan ink, while the second head 11B is provided an ink nozzle row for discharging yellow ink and magenta ink. The first and second heads 11A and 11B are formed to have a width wider than the recording paper P, and the ink nozzle row of the respective heads is arranged in a width region to cover the whole printing region.

As illustrated in FIG. 2B, the first and second heads 11A and 11B are mounted on the carriage 10, with an ink nozzle surface 11*a* facing downward. When the carriage 10 is positioned horizontally, the ink nozzle surface 11*a* is positioned horizontally. The carriage 10 holds the inkjet head 11 at a height, in which a platen gap G of a predetermined dimension is formed, between the ink nozzle surface 11*a* of the respective heads and the recording paper P passing the surface of the platen 4.

A maintenance unit 13 (maintenance means) is disposed at the side of the platen 4. The carriage 10 reciprocates the inkjet head 11 within the range from a printing position A over the platen 4 to a home position B (retraction position; position indicated by one dashed line in FIGS. 2A and 2B) over the maintenance unit 13. The inkjet head 11 takes a horizontal posture at the printing position A, in which a longitudinal direction thereof directs a direction perpendicular to a transporting direction X of the recording paper P. The ink nozzle row of the respective color installed in the first and second heads 11A and 11B covers the printing region of the recording paper P. Meanwhile, at the home position B, the inkjet head 11 takes a posture turned at a right angle from the posture at the printing position A, that is, a vertical posture in which the longitudinal direction thereof coincides with the transporting direction X.

The printer 1 performs the printing of the recording paper P by positioning and stopping the inkjet head 11 at the printing position A, and discharging the ink in this state whenever the recording paper P is transported at a predetermined pitch. Also, if the printing is completed, the printer 1 retracts the inkjet head 11 to the home position B deviated from the top of the platen 4, and stands by it at the home position B. During the stand by, a maintenance operation is performed by the maintenance unit 13 to prevent or settle clogging of the ink nozzle of the inkjet head 11. That is, the head cap installed on the upper end of the maintenance unit 13 is moved up to cap the ink nozzle surface 11*a*, and, as necessary, an operation of discharging the ink into the head cap or an operation of sucking the ink from the head cap is performed. Otherwise, the maintenance unit 13 is provided with a wiping mechanism to wipe the ink nozzle surface 11*a*. When restarting the printing, the head cap or the wiping mechanism is retracted to the lower side, and then the inkjet head 11 moves to the printing position A.

(Head Moving Mechanism)

The printer 1 includes a head moving mechanism 14 (printing head moving mechanism) for reciprocating the inkjet head 11 and the carriage 10 equipped with the inkjet head within the range from the printing position A to the home position B. FIGS. 3A to 3D are diagrams illustrating the moving process of the carriage 10 by the head moving mechanism 14. FIG. 4 is a diagram of the moving region of the carriage 10 by the head moving mechanism 14. Referring to FIGS. 3A to 3D and FIG. 4, the moving path and the moving region of the carriage 10 by the head moving mechanism 14 will now be described. The head moving mechanism 14 supports the carriage 10 at two locations, that is, a corner portion 10*a* (guided portion) at one end side of the carriage 10 in a width direction and a corner portion 10*b* at the other end side, and is configured to guide the two locations along different moving path. The corner portion 10*a* is positioned at the home position B in the printing position A, and the corner portion 10*b* is positioned at a side opposite to the home position B. As illustrated in FIGS. 3A to 3D, the moving path T1 of the corner portion 10*a* is diverted from a direction perpendicular to the transporting direction X to a direction in parallel with the transporting direction X, and the diverted portion is an arc-shaped moving path. Meanwhile, the moving path T2 of the corner portion 10*b* is a straight moving path extending in a direction perpendicular to the transporting direction X.

Figure 3A:
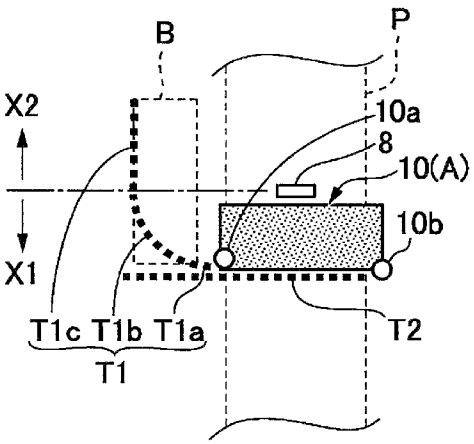
FIGS. 3A to 3D are diagrams illustrating a moving process of a carriage by the head moving mechanism.
Figure 4:
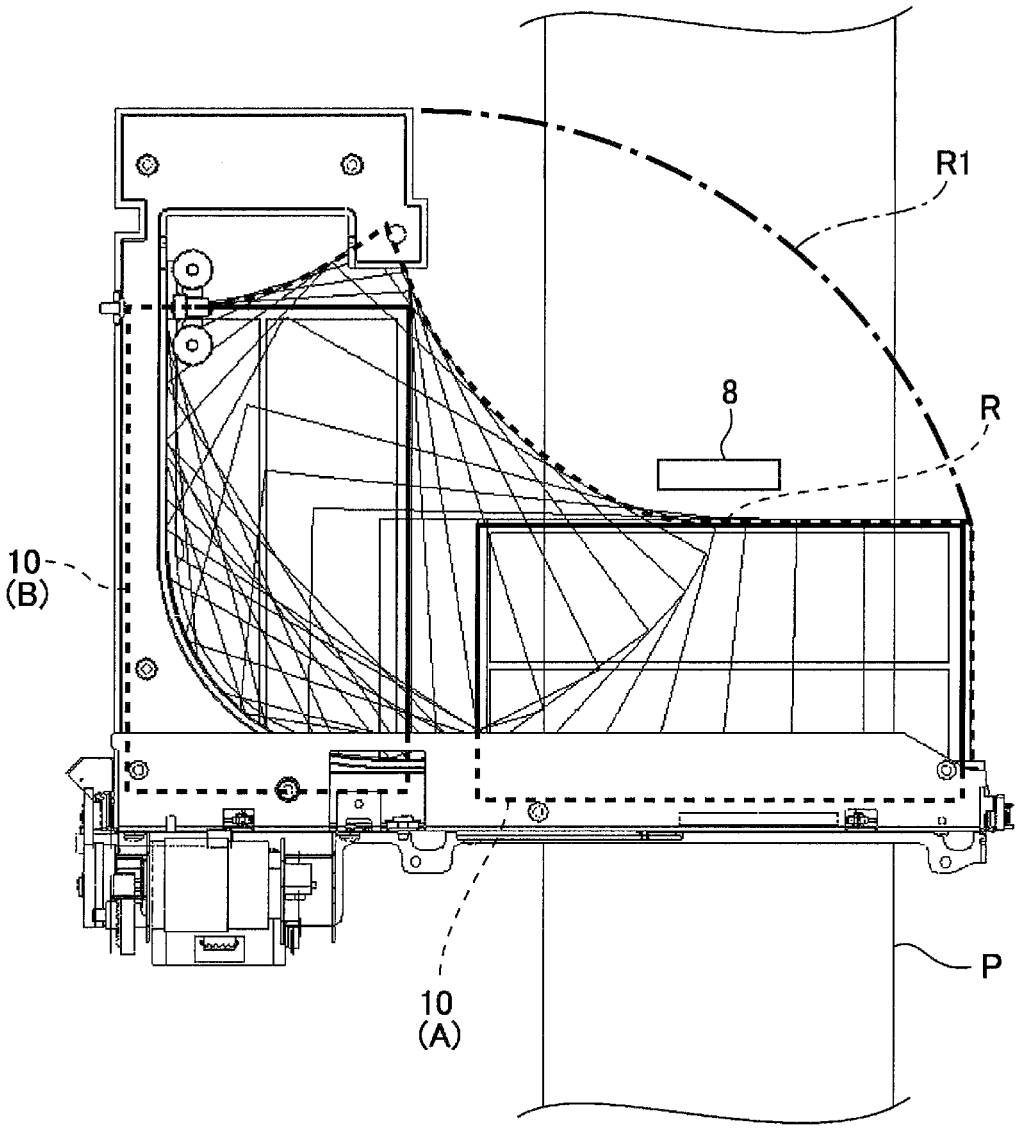
FIG. 4 is a diagram of a moving region of the carriage by the head moving mechanism.

As illustrated in FIG. 3A, the moving path T1 of the corner portion 10*a* is formed to connect a first short straight path T1*a* perpendicular to the transporting direction X, an arc-shaped path T1*b* (arc-shaped transport path), and a second straight path T1*c* in parallel with the transporting direction X in order from the printing position A. When the carriage 10 is at the printing position A, the corner portion 10*a* is on the first straight path T1*a*, while the corner portion 10*b* is on a front end portion (end portion of the printing position A) of the moving path R2. The arc-shaped path (T1*b*) is set to go away from the moving path T2 toward the home position B. In this embodiment, the position relationship among the printing position A, the home position B, and the pair of transporting rollers 8 is as follows. As illustrated in FIG. 3A, the printing position A is set at the downstream side (side indicated by the arrow X1 in FIG. 3A) of the transporting direction of the recording medium P with respect to the pair of transporting rollers 8. The home position B is set at a position retracted to the outside of the printing region of the recording paper P. Since the inkjet head 11 takes the vertical posture turned at a right angle from the home position B, one end thereof is positioned at the downstream side of the pair of the transporting rollers 8, which is identical to the case of the printing position A, but the other end is positioned at the upstream side (side indicated by the arrow X2 in FIG. 3A) of the transporting direction with respect to the pair of transporting rollers 8.

Figure 3B:
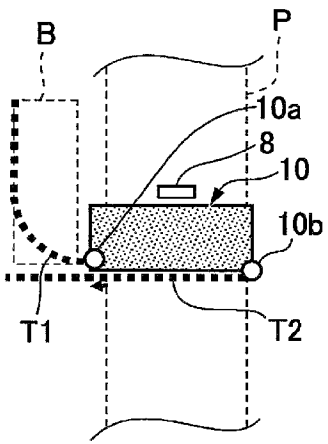
Figure 3C:
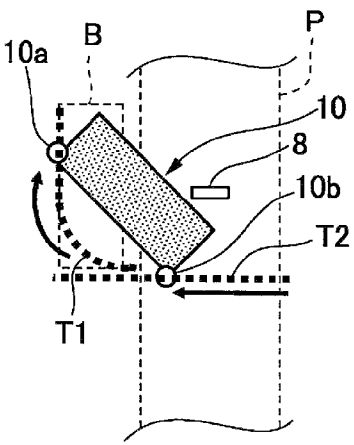
Figure 3D:
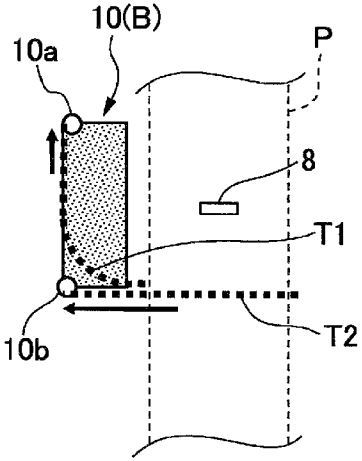

When the carriage 10 moves from the printing position A to the home position B, as illustrated in FIG. 3B, the corner portion 10*a* first moves in the direction perpendicular to the transporting direction X along the first straight path T1*a*. In this instance, since the corner portion 10*b* also moves in the direction perpendicular to the transporting direction X, the carriage 10 moves in the width direction in the same posture as the printing position A. Then, as illustrated in FIG. 3C, the corner portion 10*a* moves along the arc-shaped path T1*b*. In this instance, the corner portion 10*b* travels straight along the moving path T2, while the corner portion 10*a* moves from the moving path T2 to the upstream side of the transporting direction, and thus is gradually spaced apart from the moving path T2. For this reason, the carriage 10 moves while rotating around the corner portion 10*b* in a clockwise direction. In order to change the posture by the rotation, the carriage 10 is supported by the rotational shaft 33, which will be described later, in the state in which the corner portion 10*b* can rotate around a rotational axis perpendicular to the ink nozzle surface of the inkjet head 11. And then, when the corner portion 10*a* moves along the second straight path T1*c* and the corner portion 10*b* moves along the distal end portion (end portion at the side of the home position B) of the moving path T2, the corner portion 10*a* is more spaced apart from the moving path T2. As a result, the carriage 10 moves while rotating more in the clockwise direction. As illustrated in FIG. 3D, when the carriage 10 reaches the home position B, the carriage takes the posture turned at a right angle from the posture when it is at the printing position A. When the carriage returns from the home position B to the printing position A, the carriage moves in the reverse process.

The moving region R of the carriage 10 and the inkjet head 11 mounted on the carriage 10 when moving between the printing position A and the home position B is illustrated in FIG. 4. The moving region R slightly emerges rearward (top of FIG. 4) from the printing position A at the left end portion of the recording paper P, but does not largely emerge from the printing position A toward the upstream side of the transporting direction. Since the moving region R is a region which does not overlap with the pair of transporting rollers 8 in a plane, the carriage 10 can move between the printing position A and the home position B, without interfering with the driven roller 8*b*, which presses the recording paper P from the upward, among two rollers configuring the pair of the transporting rollers 8. For comparison, FIG. 4 illustrates the moving region R1 (head moving region by the moving method according to the related art) when the carriage 10 rotates around its one end. The moving region R1 is a sector region which largely emerges rearward from the printing region A. The moving region R1 of the related art is formed to overlap with the pair of transporting rollers 8 in a plane. In order to prevent interference with the pair of transporting rollers 8, the pair of transporting rollers 8 should be largely moved in the upstream side.

Next, each section of the head moving mechanism 14 will now be described. The head moving mechanism 14 includes a carriage frame 15 extending in a direction perpendicular to the transporting direction (direction X in FIG. 2A) by the recording paper transport path 5, and a carriage motor 16 supported by the end portion of the carriage frame 15 at the side of the home position B, as illustrated in FIG. 2A. The carriage frame 15 is supported by a device body frame of the printer 1. The end portion of the carriage frame 15 at the side of the home position B extends to the left end of the home position B, and this portion is attached to a suspended frame 17 extending to the upstream side (top of FIG. 2A) of the transporting direction along the position of the left end of the home position B. The carriage frame 15 includes a vertical plate 15*a* (see FIG. 5) extending in a vertical direction, and a horizontal plate 15*b* extending horizontally from an upper end of the vertical plate 15*a* to the upstream side of the transporting direction. A base end of the suspended frame 17 is fixed to a lower portion of the horizontal plate 15*b*.

Figure 5:
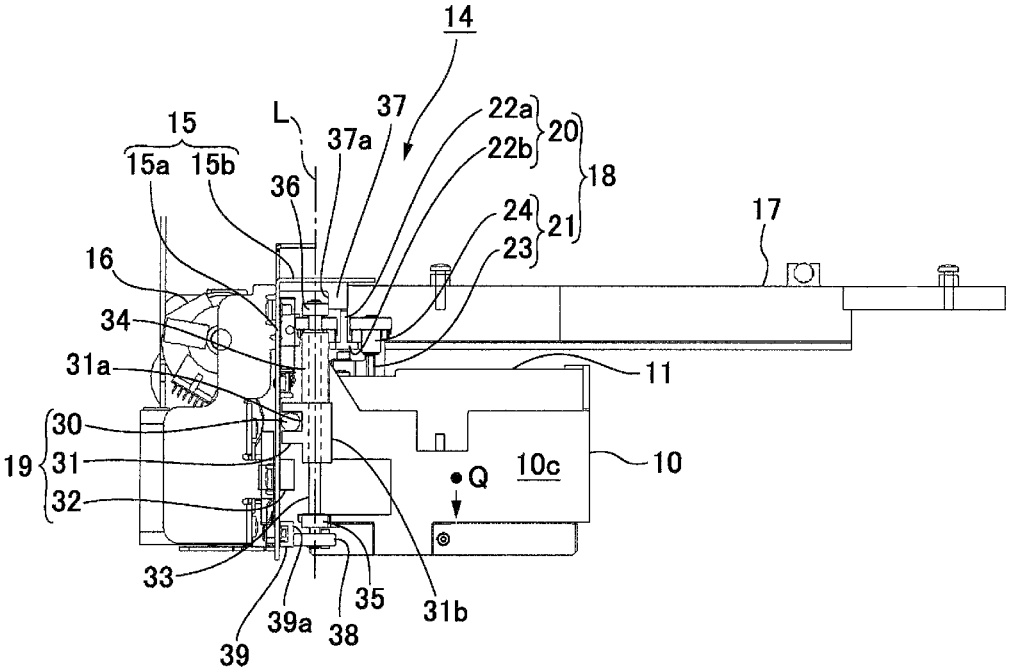
FIG. 5 is a side view of the head moving mechanism.
Figure 6:
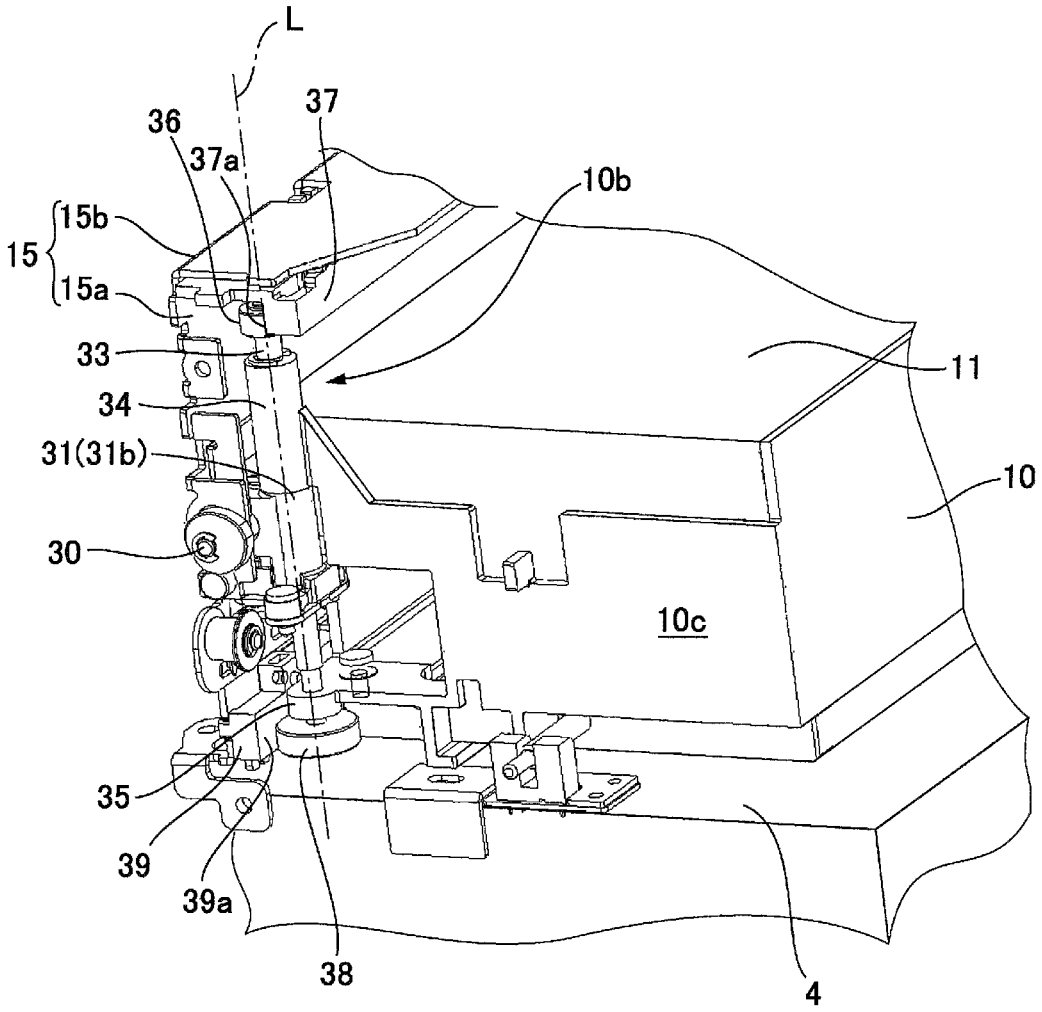
FIG. 6 is a perspective view illustrating a detector for a gap between a platen and an end portion of the head moving mechanism at a side of a printing position.
Figure 7:
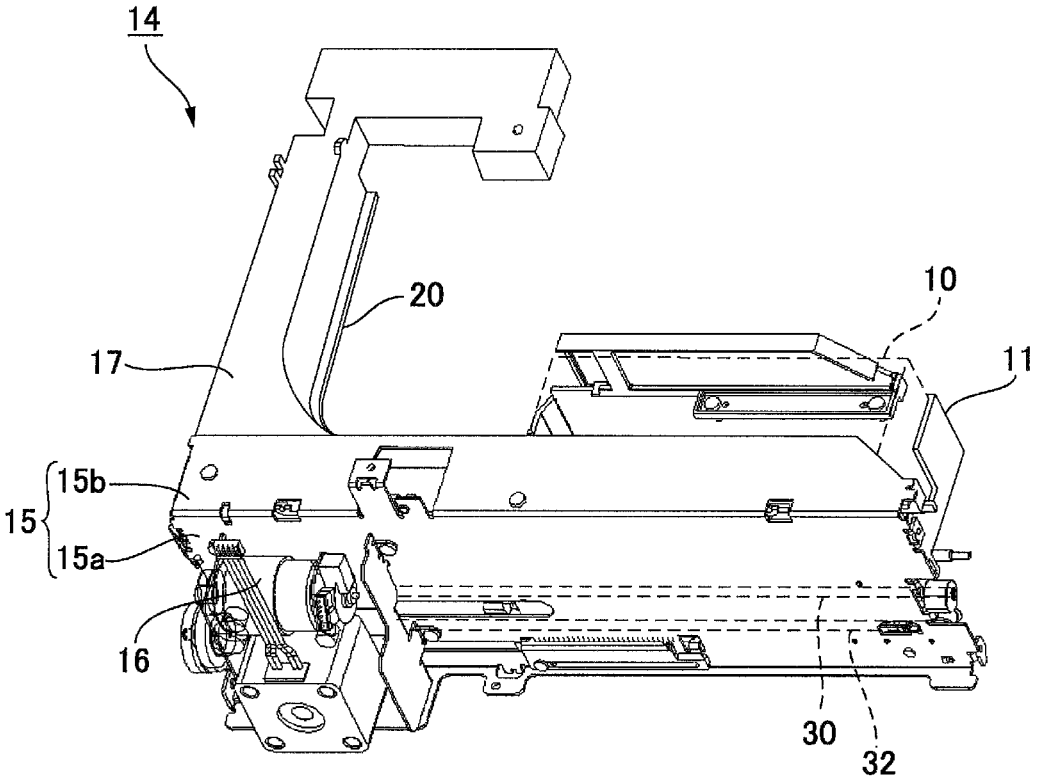
FIG. 7 is a perspective view of the head moving mechanism when seen from a top at an angle.
Figure 8A:
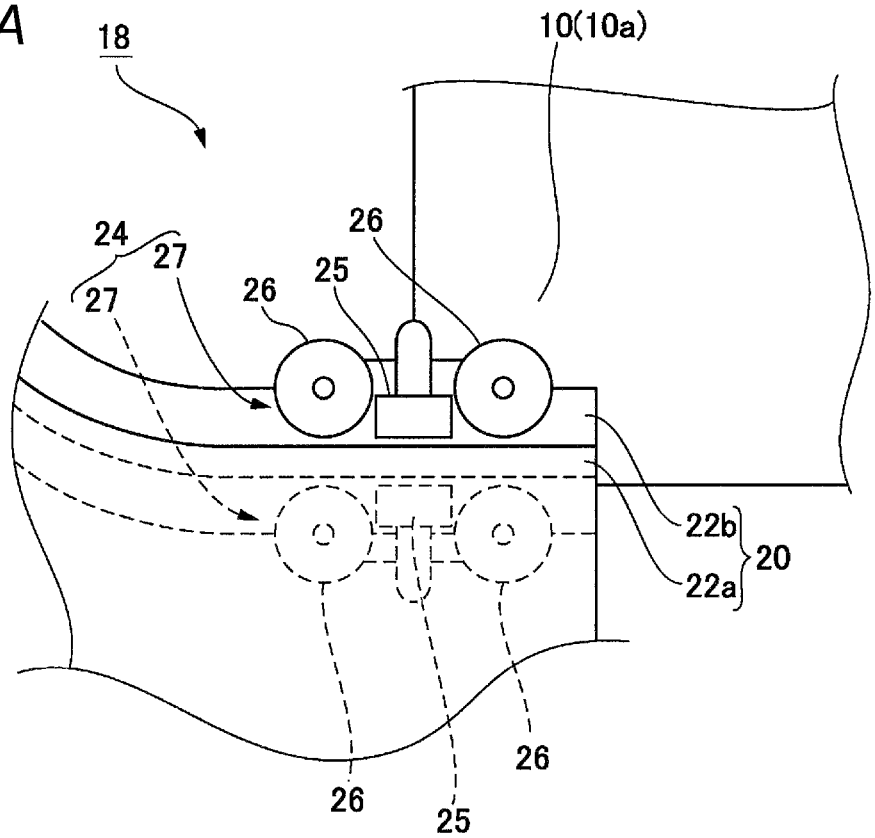
FIGS. 8A and 8B are diagrams of a monorail mechanism.
Figure 8B:
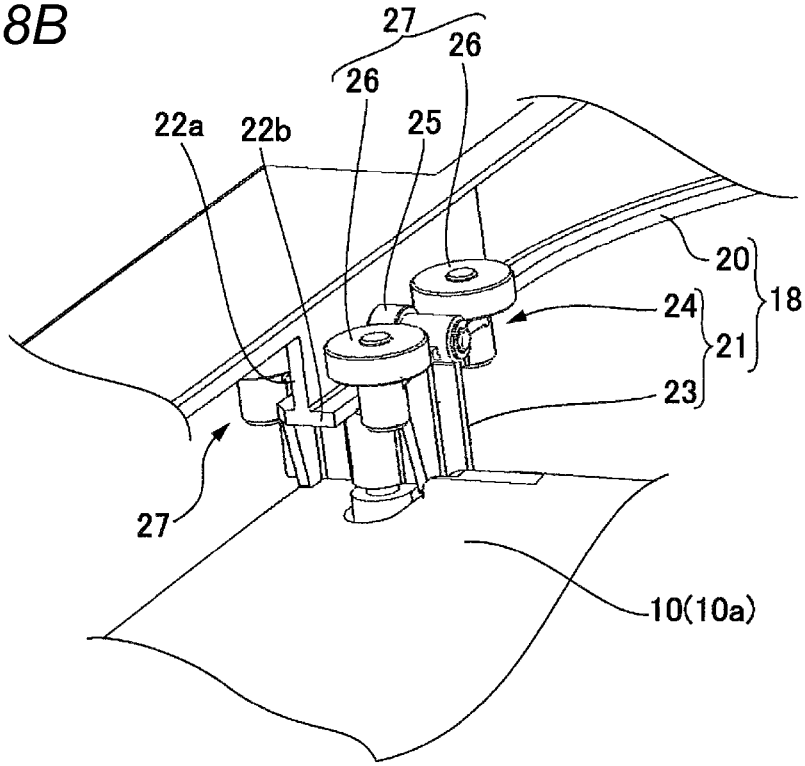

FIG. 5 is a side view of the head moving mechanism (side view when seen from the direction Y1 in FIG. 2A), and the right portion of the line Z-Z in FIG. 2A is not illustrated. Also, FIG. 6 is a perspective view illustrating a detector for the gap between the platen and the end portion of the head moving mechanism 14 at the side of the printing position A (perspective view when seen from the direction Y2 in FIG. 2A). FIG. 7 is a perspective view of the head moving mechanism when seen from the top at an angle. FIGS. 8A and 8B are diagrams of a monorail mechanism for suspending the carriage 10, in which FIG. 8A is a diagram illustrating a plane configuration, and FIG. 8B is a partial perspective view. The head moving mechanism 14 includes a monorail mechanism 18 (second guide section) for suspending the corner portion 10*a* at the side of the home position B and guiding it along the moving path T1 having the arc-shaped path T1*b*, and a slide guide mechanism 19 (first guide section) for guiding the corner portion 10*b* at the side opposite to the home position B along the straight moving path T2.

The monorail mechanism 18 has a guide rail 20 formed on an edge of the suspended frame 17 at the side of the platen 4, and a suspending section 21 installed at the corner portion 10*a* to suspend the corner portion 10*a* of the carriage 10 from the guide rail 20. The guide rail 20 has a first short straight rail portion 20A defining the first straight path T1*a*, an arc-shaped rail portion 20B defining the arc-shaped path T1*b* and extending in an arc shape from the left end of the first straight rail portion 20A to the upstream side of the transporting direction, and a second straight rail portion 20C defining the second straight path T1*c* and extending in parallel with the transporting direction X from the rear end of the arc-shaped rail portion 20B, as illustrated in FIG. 2A. Each portion of the guide rail 20 has a vertical wall portion 22*a* extending downward, and a horizontal portion 22*b* extending horizontally from a lower end of the wall portion 22*a* to both sides of the wall portion 22*a*, as illustrated in FIG. 5 and FIGS. 8A and 8B. Each portion has an inverted T-shaped cross section.

The suspending section 21 has a protrusion portion 23 protruding from the corner portion 10*a* of the carriage 8*b* to the guide rail 20, and a traveling section 24 installed on a front end of the protrusion portion 23, as illustrated in FIG. 8B. The traveling section 24 is attached to the protrusion portion 23 in such a way that the traveling section can rotate around the rotation axis (not illustrated) to a vertical direction (i.e., a direction vertical to the ink nozzle surface 11*a*) when the carriage 10 is horizontally positioned. The traveling section 24 has roller units 27 each having a traveling roller 25 with an axis direction being horizontal, and a pair of guide rollers 26, with the traveling roller 25 being interposed between the guide rollers 26. The roller units 27 are disposed opposite to each other at an interval corresponding to the thickness of the wall portion 22*a*. Each of the guide rollers 26 is disposed in a direction vertical to the axis direction. The traveling section 24 is mounted on the guide rail 20 in the state in which the wall portion 22*a* is inserted into the interval of the roller units 27 and the respective traveling rollers 25 is laid on the horizontal portion 22*b*. Accordingly, while both front and rear surfaces of the wall portion 22*a* are guided by the guide roller 26, each traveling roller 25 can travel on the horizontal portion 22*b*, without being fallen. If the traveling section 24 travels along the guide rail 20, the corner portion 10*a* moves along the moving path T1 defined by the first straight rail portion 20A, the arc-shaped rail portion 20B and the second straight rail portion 20C, in the state in which the corner portion is suspended from the guide rail 20.

The slide guide mechanism 19 includes a carriage shaft 30 (guide member) extending horizontally in a direction perpendicular to the transporting direction X along the vertical plate 15*a* of the carriage frame 15, a slider 31 slidably supported by the carriage shaft 30, and a drive belt mechanism 32 (drive means) for reciprocating the slider 31 along the carriage shaft 30, as illustrated in FIGS. 5 and 7. The drive belt mechanism 32 is driven by output rotation of the carriage motor 16. As illustrated in FIG. 5, the slider 31 is provided with a groove 31*a* of an angular cross section extending horizontally, and the carriage shaft 30 is mounted in the groove 31*a*. The slider 31 slides along the carriage shaft 30, while sliding along the inner surface of the groove 31*a* on the surface of the carriage shaft 30. The slider 31 is provided with a shaft holding portion 31*b* at a rear surface of the groove 31*a*. The shaft holding portion 31*b* rotatably holds the vertical rotational shaft 33 attached to the corner portion 10*b* of the carriage 10.

As illustrated in FIGS. 5 and 6, the carriage 10 is provided with a cylindrical portion 34 at the upper portion of the corner portion 10*b*, and the rotational shaft 33 is inserted into the cylindrical portion 34. The lower end portion of the corner portion 10*b* is provided with a disc-shaped portion 35 disposed coaxially with the cylindrical portion 34. The lower end portion of the rotational shaft 33 is inserted into an axial hole formed in the center of the disc-shaped portion 35. When the carriage 10 is horizontally positioned, the rotational shaft 33 is attached so that the rotational axis L is vertical to the ink nozzle surface 11*a* and a printed surface of the printing paper P opposite to the nozzle surface. The lower portion of the cylindrical portion 34 of the carriage 10 is formed in a concave shape to which the shaft holding portion 31*b* of the slider 31 can be mounted. The shaft holding portion 31*b* is inserted into the slider 31, and the center portion of the rotational shaft 33 is inserted into the axial hole of the shaft holding portion 31*b*. With the configuration, the carriage 10 is rotatably held by the slider via the rotational shaft 33, and the weight of the corner portion 10*b* of the carriage 10 is supported by the carriage shaft 30 via the slider 31. If the slider 31 reciprocates along the carriage shaft 30, the corner portion 10*b* of the carriage 10 and the rotational shaft 33 reciprocate in a direction perpendicular to the transporting direction X along the carriage shaft 30.

The upper end of the rotational shaft 33 protrudes from the cylindrical portion 34, and an upper guide roller 36 is attached to a front end of the cylindrical portion 34. An upper guide 37 having a rectangular cross section protruding downward is attached to the lower side of the horizontal plate 15*b* which is installed to the upper end portion of the carriage frame 15. The upper guide roller 36 is interposed between the upper guide 37 and the upper end portion of the vertical plate 15*a* in the carriage frame 15. The upper guide 37 abuts against the upper guide roller 36 from the right side in FIG. 5. Similarly, the lower end of the rotational shaft 33 protrudes to the lower side of the disc-shaped portion 35, and a lower guide roller 38 is attached to a front end of the rotational shaft 33. A lower guide 39 is attached to the lower end portion of the vertical plate 15*a* of the carriage frame 15, and protrudes to the lower guide roller 38 at the portion of the same height as the lower guide roller 38. The lower guide 39 abuts against the lower guide roller 38 from the left side in FIG. 5.

When the carriage 10 reciprocates along the carriage shaft 30, the upper guide roller 36 is guided by a lateral surface 37*a* of the upper guide 37, while the lower guide roller 38 is guided by a lateral surface 39*a* of the lower guide 39. The carriage 10 is supported in a cantilever state through the slider 31 which supports the center portion of the rotational shaft 33, and the center of gravity Q of the carriage 10 is deviated from the rotational shaft 33. For this reason, the rotational shaft 33 is applied with a rotational force (rotational force in a clockwise direction in FIG. 5) to tilt the upper end of the rotational shaft 33 toward the center of gravity Q of the carriage 10. However, the upper guide 37 is disposed at the side (right side in FIG. 5) of the center of gravity Q with respect to the upper guide roller 36, while the lower guide 39 is disposed at the side (left side in FIG. 5) opposite to the center of gravity Q with respect to the lower guide roller 38. As a result, it is possible to prevent the rotational shaft 33 from tilting in an inclined direction caused by the weight of the carriage, so that the carriage 10 is maintained in a horizontal posture.

As described above, with the printer 1 of this embodiment, in the case where the printing position A is set at the downstream side of the pair of transporting rollers 8, and the home position B is set at the position in which the one end of the carriage 10 is moved to the upstream side of the pair of transporting rollers 8, the carriage 10 can move between the printing position A and the home position B, without interfering with the pair of transporting rollers 8 disposed at the upstream side of the printing position A. Accordingly, since it is not necessary to retract the pair of transporting rollers 8 to the upstream side, a printing mechanism and a transporting mechanism can be intensively disposed in a narrow space, so that it is advantageous to downsizing of the printer 1.

That is, in this embodiment, on the way to move from the printing position A to the home position B, the carriage 10 can be rotated around the rear end portion, and can take the posture turned at a right angle at the home position B. Accordingly, the width of the retracted space which has to be secured at the side of the platen 4 can be decreased, thereby suppressing the increase in the device width of the printer 1. Also, as illustrated in FIG. 4, when the carriage moves in the moving path, the moving region R of the carriage 10 does not largely emerge toward the upstream side (top of FIG. 4) of the printing position A as compared to the sector-shaped moving region R1 of the related art. Accordingly, several components, such as a pair of transporting rollers 8, can be disposed in the moving region R1, in which these components cannot be disposed in the configuration of the related art. Accordingly, the printing mechanism and the transporting mechanism can be intensively disposed in the narrow space, so that it is advantageous to downsizing of the printer 1.

In addition, in this embodiment, since the carriage 10 is moved by not driving the corner portion 10*a* moving in the arc shape, but driving the corner portion 10*b* moving in the straight shape, the drive belt mechanism 32 can be disposed in a straight shape. Accordingly, it is possible to simplify the configuration of the drive mechanism for moving the carriage. Also, since the corner portion 10*a* is guide by the monorail mechanism 18 suspending it from the top, a mechanism for guiding the corner portion 10*a* can be configured to save a space, it is possible to suppress the increase in the device width.

Further, in this embodiment, since the corner portion 10*a* is moved along the arc-shaped path T1*b*, the carriage 10 can be smoothly rotated. Also, since the first straight path T1*a* is set at the first straight path T1*a* is set at a beginning end portion of the moving path T1 of the corner portion 10*a*, the position of the width direction can be finely adjusted in the range in which the corner portion 10*a* moves along the first straight path T1*a*, without changing the posture of the carriage 10. Accordingly, it is possible to finely adjust the position of the inkjet head 11 in the width direction at the printing position A, so that the inkjet head 11 can be positioned in the width direction with respect to the recording paper P.

(Modified Example)

(1) The carriage takes the posture turned at a right angle at the home position B in this embodiment, but as the moving paths T1 and T2 are appropriately set, the posture of the carriage 10 at the home position B can be changed to a posture tilted at a desired angle.

(2) In this embodiment, as the first straight path T1*a* is set at one end of the moving path T2, the position of the carriage is determined in the width direction at the printing position A. However, a moving path portion can be set at the end of the moving paths T1 and T2 at the side of the home position B to determine the accurate position of the carriage 10 at the home position B.

(3) In this embodiment, the arc-shaped path T1*b* defined by the arc-shaped rail portion 20B in FIG. 2A and the second straight path T1*c* connected to the rear end of the arc-shaped path are set as the moving path for moving the corner portion 10*a* serving as a leading portion when moving to the home position B. However, the moving path of the corner portion 10*a* is not limited to the shape, and can be appropriately changed within the range such that the carriage does not interfere with the pair of transporting rollers 8. For example, a diameter size of the arc-shaped path T1*b* is reduced, and the first straight path T1*a* and the second straight path T1*c* can be set to be so long as the diameter size is reduced. Also, the arc-shaped path T1*b* may be set to have a bent shape other than the arc. Otherwise, instead of the arc-shaped path T1*b*, an oblique moving path may be set to interest with the first straight path T1*a* and the second straight path T1*c* at an angle of 45°. Even by such a shape, the carriage 10 can be rotated while moving to the home position B, like this embodiment. Accordingly, similar to the moving region R in FIG. 4, the carriage can move through the region which does not largely emerge from the printing position A.

(4) The corner portion 10*b* of the carriage 10 moves along the straight moving path T2 in this embodiment, but the moving path of the corner portion 10*b* may be appropriately changed within the range which does not interfere with the pair of transporting rollers 8. For example, a portion of the moving path of the corner portion 10*b* may be moved to the upstream side or downstream side of the transporting direction within the range which does not interfere with the pair of transporting rollers 8. For example, a path may be set in which as it comes close to the end position of the recording paper P at the side of the home position B, the corner portion 10*b* is moved to the downstream side of the transporting direction, and then is returned to the upstream side. In this way, it is possible to reduce an emerging amount toward the upstream side, due to the rotation (posture change) of the carriage 10, as much as possible.

(5) The position of the carriage 10 supported by the monorail mechanism 18 is set as the end (corner portion 10*a*) of the carriage 10 in this embodiment, the position supported by the monorail mechanism 18 may be set to be deviated from the position. For example, the portion closer to the corner portion 10*b* may be configured to support the monorail mechanism 18. Otherwise, the corner portion positioned on a diagonal line to the corner portion 10*b* may be configured to support the monorail mechanism 18. In this instance, after it is determined in advance that the newly set support position is moved along any moving trace when the carriage 10 moves, as illustrated in FIGS. 3A to 3D and FIG. 4, the guide rail 20 of the monorail mechanism 18 may be installed to have a shape corresponding to the determined moving trace.

Other Embodiments

The head moving mechanism 14 of the above embodiment is configured to rotate and move the carriage 10 by supporting it at two points and guiding each fulcrum using the monorail mechanism 18 and the slide guide mechanism 19, but it is possible to move the carriage 10 using a mechanism of other configuration, as illustrated in FIGS. 3A to 3D and FIG. 4. For example, it can be configured to support the carriage 10 at only the corner portion 10*b*, and the slider 31 can be provided with a rotating mechanism for rotating the carriage around the rotational shaft 33, in which the slider 31 is moved along the carriage shaft 30 to rotate the carriage 10, and the corner portion 10*b* is moved in a straight to change the posture of the carriage 10. In this instance, the position of the slider 31 and the rotation angle of the carriage 10 may be cooperated by control, or a mechanism for moving the slider 31 in a straight and a rotating mechanism of the carriage 10 may be mechanically cooperated to move the carriage 10 as FIGS. 3A to 3D and FIG. 4.

Otherwise, even though the rotating shaft for rotatably supporting the carriage 10 and the rotating mechanism for rotating the carriage 10 around the rotating shaft are installed at a position different from the corner portion 10*b*, it is possible to achieve the movement of the carriage 10 as FIGS. 3A to 3D and FIG. 4. In this instance, after it is determined in advance the moving trace of the rotating shaft when the carriage 10 moves as FIGS. 3A to 3D and FIG. 4, a guide mechanism for guiding the rotating shaft may be installed along the along trace, and the rotation angle by the rotating mechanism may be changed in accordance with the guide position of the guide mechanism. In this way, the movement as illustrated in FIGS. 3A to 3D and FIG. 4 can be achieved by several configurations, in which the rotating shaft for rotatably supporting the carriage 10 around the rotating axis vertical to the ink nozzle surface 11*a* is installed at a desired portion of the carriage 10, and the rotating shaft is moved to change the posture of the carriage 10, when the carriage 10 moves between the printing position A and the home position B.

What is claimed is:

1. A printing head moving mechanism configured to reciprocate a carriage equipped with a printing head between a printing position facing a recording medium and a retracted position retracted outside a printing region of the recording medium, wherein in the printing position, the carriage is disposed at a downstream side of a transporting roller which is configured to transport the recording medium in a transporting direction of the recording medium, wherein in the retracted position, at least a portion of the carriage is disposed at an upstream side of the transporting roller in the transporting direction of the recording medium, wherein the carriage is configured to move between the printing position and the retracted position without interfering with the transporting roller, wherein the print head moving mechanism includes a first guide section comprising a carriage shaft and a second guide section comprising a guide rail, the carriage shaft and the guide rail guiding the carriage between the printing position and the retracted position, and the carriage shaft and the guide rail extending along paths which differ from one another, wherein in at least a portion of a moving region between the printing position and the retracted position, when the carriage moves toward the retracted position, a posture of the carriage is changed such that a trailing end portion of the carriage in a moving direction thereof moves along a straight moving path while a leading end portion of the carriage in the moving direction thereof moves away from the straight moving path, and when the carriage moves toward the printing position, a posture of the carriage is changed such that a leading end portion of the carriage in a moving direction thereof moves along the straight moving path while a trailing end portion of the carriage in the moving direction thereof moves towards the straight moving path, wherein the first guide section is configured to guide one end of the carriage in a width direction thereof along the straight moving path, wherein the second guide section is configured to guide a guided portion which is provided in a portion of the carriage, positioned at a front side of the one end of the carriage in a moving direction when the carriage moves from the printing position toward the retracted position, along a moving path including a path portion which extends in a direction away from the straight moving path as the path portion proceeds toward the retracted position, wherein the path portion is an arc-shaped moving path, and wherein the second guide section includes:

a first straight guide portion of the guide rail provided at an end portion of the moving path of the guided portion at a side of the printing position and configured to guide the guided portion along a first straight path parallel to the straight moving path; and an arc-shaped guide portion of the guide rail connected to an end portion of the first straight guide portion at a side of the retracted position and configured to guide the guided portion along the arc-shaped moving path.

* * * * *